US006435308B2

(12) United States Patent
Grass

(10) Patent No.: US 6,435,308 B2
(45) Date of Patent: Aug. 20, 2002

(54) DRIVE CONFIGURATION FOR STAIR LIFTS

(76) Inventor: Gerd Grass, Talstrasse 16, D-32760 Detmold (DE)

( * ) Notice: Subject to any disclaimer, the term of this patent is extended or adjusted under 35 U.S.C. 154(b) by 0 days.

(21) Appl. No.: 09/803,758

(22) Filed: Mar. 12, 2001

(30) Foreign Application Priority Data

Mar. 10, 2000 (DE) ..... 100 11 627

(51) Int. Cl.[7] ..... B66B 9/08
(52) U.S. Cl. ..... 187/201; 198/321; 187/270
(58) Field of Search ..... 187/200, 201, 187/207, 270; 198/321, 330

(56) References Cited

U.S. PATENT DOCUMENTS 2,424,055 A * 7/1947 Rousseau ..... 198/177
3,833,092 A * 9/1974 Flinchbaugh ..... 187/12
3,966,022 A * 6/1976 Cheney ..... 187/270
4,174,023 A * 11/1979 Dooley ..... 187/12
4,179,012 A * 12/1979 Herberle ..... 187/12
4,335,805 A * 6/1982 Grass ..... 187/12
4,564,086 A * 1/1986 Kingston ..... 187/12
4,756,387 A * 7/1988 Grass ..... 187/201
5,193,650 A * 3/1993 Kent, Jr. ..... 198/322
5,217,089 A * 6/1993 Virk ..... 198/321
5,641,040 A * 6/1997 Grass ..... 187/201
5,908,087 A * 6/1999 Johansson ..... 187/201
6,155,382 A * 12/2000 Duijnstee ..... 187/200

* cited by examiner

*Primary Examiner*—Douglas Hess
(74) *Attorney, Agent, or Firm*—Laurence A. Greenberg; Werner H. Stemer; Ralph E. Locher

(57) ABSTRACT

A drive configuration for stair lifts is described. The drive configuration has a load-bearing configuration which is mounted displaceably on a first (bottom) guide rail and a second (top) guide rail. A drive unit interacts with a drive rail. The drive rail is formed by a perforated bar which has engagement openings spaced apart at regular intervals in the longitudinal direction and also has two uninterrupted, mutually opposite running surfaces. The drive unit has two gearwheel-shaped drive wheels which are disposed opposite one another, and accommodate the perforated bar with a radial contact-pressure force between them. The drive wheels have drive surfaces which are uninterrupted in the circumferential direction and radially projecting drive protrusions, the drive protrusions interacting with the engagement openings in a form-fitting drive connection and the drive surfaces interacting with the running surfaces in a force-fitting drive connection.

27 Claims, 7 Drawing Sheets

DRIVE CONFIGURATION FOR STAIR LIFTS

BACKGROUND OF THE INVENTION

Field of the Invention

The invention relates to a drive configuration for stair lifts. The drive configuration has a load-bearing configuration which is mounted displaceably on a first (bottom) guide rail and a second (top) guide rail, and has a drive device interacting with a drive rail.

German Patent DE 42 11 870 C1 discloses a drive configuration of the generic type in which the propelling force is transmitted to a drive member of rectangular cross section via drive rollers. This driving takes place in an exclusively force-fitting manner. In order to achieve the necessary propelling force with permissible contact pressures here, four drive rollers are necessary. This results in a problem of rollers being constrained over curves of the drive member.

It has been found, in practice, that two rollers acting in a force-fitting manner are not sufficient. European Patent EP 0 525 141 and German Utility Model DE-U-9211115 describe purely force-fitting drives in which separate pairs of rollers act on bottom and top tubular guides. In this case, high forces in the case of a possible low coefficient of friction of 0.1 (when wet) in the steel/steel material pairing and the running rollers butting against the tubular guide all the way around are disadvantageous. A purely roaming operation is only present at the smallest roller diameter, sliding taking place between the rollers and tube at the flanks, and this sliding, even in the case of tubular guides made of stainless steel, results in the formation of grooves and ridges, which may cause injury since the top tubular guide is also used as a handrail.

Furthermore, the lift-construction regulations do not allow any monitoring of speed, which is necessary for an arresting mechanism, by force fitting without additional measures, for example an electronic slippage-monitoring device, which gives rise to additional costs.

SUMMARY OF THE INVENTION

It is accordingly an object of the invention to provide a drive configuration for stair lifts that overcomes the above-mentioned disadvantages of the prior art devices of this general type, in which the tubular guides which are also used as a handrail are not subjected to any excessive contact pressure by drive rollers.

With the foregoing and other objects in view there is provided, in accordance with the invention, a drive configuration for stair lifts. The drive configuration contains a load-bearing configuration which is to be mounted displaceably on guide rails including a first guide rail and a second guide rail. A drive rail having engagement openings formed therein and spaced apart at regular intervals in a longitudinal direction is provided. A drive unit interacts with the drive rail and is supported by the load-bearing configuration. The drive unit has two gearwheel-shaped drive wheels disposed opposite one another and accommodate the drive rail with a contact-pressure force acting on the drive wheels to engage the drive rail. The drive wheels have radially projecting drive protrusions interacting with the engagement openings in a form-fitting drive connection.

The object is achieved according to the invention by a drive configuration for stair lifts, having the load-bearing configuration which is mounted displaceably on a first (bottom) guide rail and a second (top) guide rail. The drive configuration further has a drive unit interacting with a drive rail, which is distinguished in that the drive rail has engagement openings spaced apart at regular intervals in the longitudinal direction. The drive unit has two gearwheel-like drive wheels which are disposed opposite one another, accommodate the drive rail, with a radial contact-pressure force, between them and have radially projecting drive protrusions. The drive protrusions interact with the engagement openings in a form-fitting drive connection and the drive surfaces interact with running surfaces in a force-fitting drive connection.

The invention also relates to a stair lift having a drive configuration according to the invention.

In accordance with an added feature of the invention, the drive rail is a perforated bar having the engagement openings formed therein and two uninterrupted, mutually opposite running surfaces. The drive wheels have drive surfaces which are uninterrupted in a circumferential direction and interact with the running surfaces in a force-fitting drive connection.

In accordance with an additional feature of the invention, the drive rail having the engagement openings is a groove bar with grooves formed therein and spaced apart at regular intervals in the longitudinal direction.

In accordance with another feature of the invention, the drive rail has a given thickness and the drive protrusions have a radial length corresponding approximately to half of the given thickness of the drive rail. The drive protrusions are bolts inserted into the drive wheels. In addition, the drive protrusions on the drive wheels are spaced apart by an angle of 20° in a circumferential direction.

In accordance with a further feature of the invention, the perforated bar has in each case one of the running surfaces disposed on each side of the engagement openings, and the drive wheels have in each case one of the drive surfaces on each side of the drive protrusions.

In accordance with another added feature of the invention, the perforated bar is produced from a flat steel bar and the engagement openings are punched.

In accordance with another additional feature of the invention, a pressure assembly having springs for producing an adjustable contact-pressure force being the contact pressure force exerted on the drive wheels is provided.

In accordance with another further feature of the invention, the drive unit has inter-engaging coupling gearwheels and shafts. Each of the drive wheels is mounted on one of the shafts, and the shafts are parallel to each other and connected in a rotationally fixed manner to the inter-engaging coupling gearwheels.

In accordance with a further added feature of the invention, the drive rail is retained at a fixed spacing from the guide rails and is fitted such that it is angle-adjustable and height-adjustable.

In accordance with a further additional feature of the invention, the drive protrusions are in a form of truncated cones and the engagement openings are in a form of double truncated cones.

In accordance with an added feature of the invention, the drive rail is to be retained on uprights which are disposed between the guide rails.

In accordance with an additional feature of the invention, a carrying frame which bears a load which is to be transported is mounted in a vertically displaceable manner on the load-bearing configuration. A housing carrying the drive wheels is retained pivotably on the carrying frame, and with a progression of the drive wheels along the drive rail, the housing defines a height position of the carrying frame relative to the load-bearing configuration.

In accordance with another feature of the invention, in an end region of the guide rails, the drive rail is guided in a direction of the first guide rail.

In accordance with a further feature of the invention, the load-bearing configuration has guide rollers and is guided on the guide rails in each case by two of the guide rollers.

In accordance with another added feature of the invention, a drive motor is fixed on the carrying frame and has a gear mechanism.

In accordance with another additional feature of the invention, a carrying frame bearing a load which is to be carried is mounted in a vertically displaceable manner on the load-bearing configuration. The drive wheels are mounted on the load-bearing configuration and the carrying frame has at least one carrying roller and is guided and supported on one of the guide rails by way of the at least one carrying roller. A drive motor is disposed on the carrying frame. A chain wheel is connected in a rotationally fixed manner to one of the drive wheels. A first deflecting wheel is disposed on the load-bearing configuration and a second deflecting wheel is disposed on the carrying frame. An endless drive chain drives one of the drive wheels. The endless drive chain is guided in each case over the first deflecting wheel and the second deflecting wheel, so that, during operation of the drive configuration, tractive chain forces result in a vertically upwardly directed raising force between the load-bearing configuration and the carrying frame.

In accordance with another further feature of the invention, the load-bearing configuration is guided and supported on the second guide rail and on the perforated bar. The drive rail is disposed at a fixed spacing beneath the second guide rail.

In accordance with an added feature of the invention, the carrying frame is to be supported on the first guide rail, the first guide rail is to be disposed at one of a predeterminable and adjustable, locally different spacing from the second guide rail and the drive rail. As a result of which it is possible to predetermine a local vertical position of the carrying frame relative to the load-bearing configuration.

In accordance with an additional feature of the invention, the carrying frame is to be supported on the first guide rail by at least one carrying roller.

In accordance with another feature of the invention, the load-bearing configuration has a pair of rollers for supporting the load-bearing configuration on the second guide rail.

In accordance with a further feature of the invention, the carrying frame has a top region and the drive motor is disposed in the top region of the carrying frame.

In accordance with another added feature of the invention, a drive chain wheel is driven by the drive motor. The endless drive chain is routed to the second deflecting wheel, and, from there, to the first deflecting wheel and, from there, to the chain wheel and back to the drive chain wheel.

In accordance with another additional feature of the invention, a platform for transporting a transportable load is disposed on the carrying frame.

In accordance with a concomitant feature of the invention, the drive rail is retained at locally different spacings from the guide rails and is fitted such that it is angle-adjustable and height-adjustable.

Other features which are considered as characteristic for the invention are set forth in the appended claims.

Although the invention is illustrated and described herein as embodied in a drive configuration for stair lifts, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
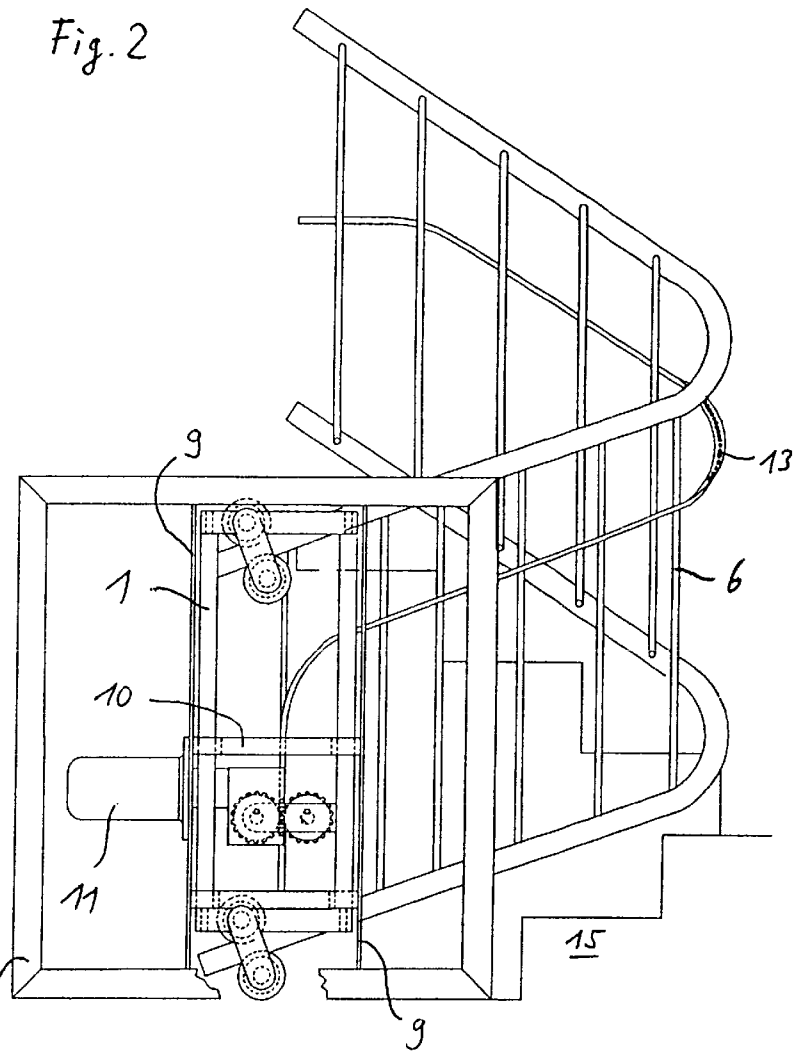
FIG. 2 is a side-elevational view of the stair lift, a load-bearing configuration being located at an end point and a carrying frame being located in a lowered position.

In all the figures of the drawing, sub-features and integral parts that correspond to one another bear the same reference symbol in each case. Referring now to the figures of the drawing in detail and first, particularly, to FIG. 1 thereof, there is shown a stair lift according to the invention at the foot of a staircase. A load-bearing configuration 1, which is illustrated essentially in the form of a frame, is mounted and guided displaceably on a first, bottom guide rail 3 by way of bottom guide rollers 2, which are disposed in a pair, and on a second, top guide rail 5 by way of top guide rollers 4, which are disposed in pairs. In the embodiment illustrated, the guide rails 3, 5, together with uprights 6, form a staircase railing, the top guide rail 5 serving as a handrail.

Figure 1:
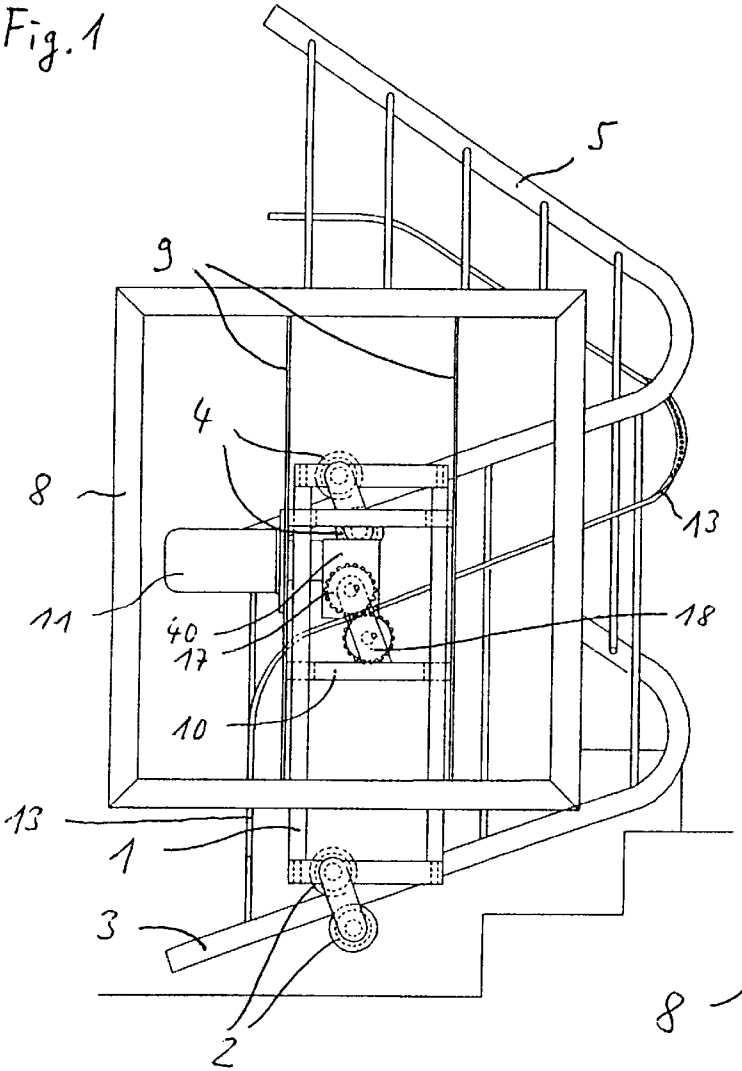
FIG. 1 is a diagrammatic, side-elevational view of a stair lift in a travelling position according to the invention.

As can be gathered from FIGS. 1 and 2, a carrying frame 8 which bears a load which is to be transported is mounted in a vertically displaceable manner on the load-bearing configuration 1. The carrying frame 8, in the present case, being provided with vertical guide members 9 and cross-members 10, on which there are retained a drive motor 11 and other drive elements which are yet to be explained.

A perforated bar 13, which is produced from a flat steel bar by punching out holes from the latter, is fastened on the uprights 6 in a region between the guide rails 3 and 5 and runs at an essentially constant spacing from, and parallel to, the guide rails 3, 5. Whereas, in the initial region of the lift, in front of a lowermost stair 15 of the staircase, it is guided downward in the direction of the first guide rail 3 and, in its bottom end region, runs more or less or fully vertically.

Figure 3:
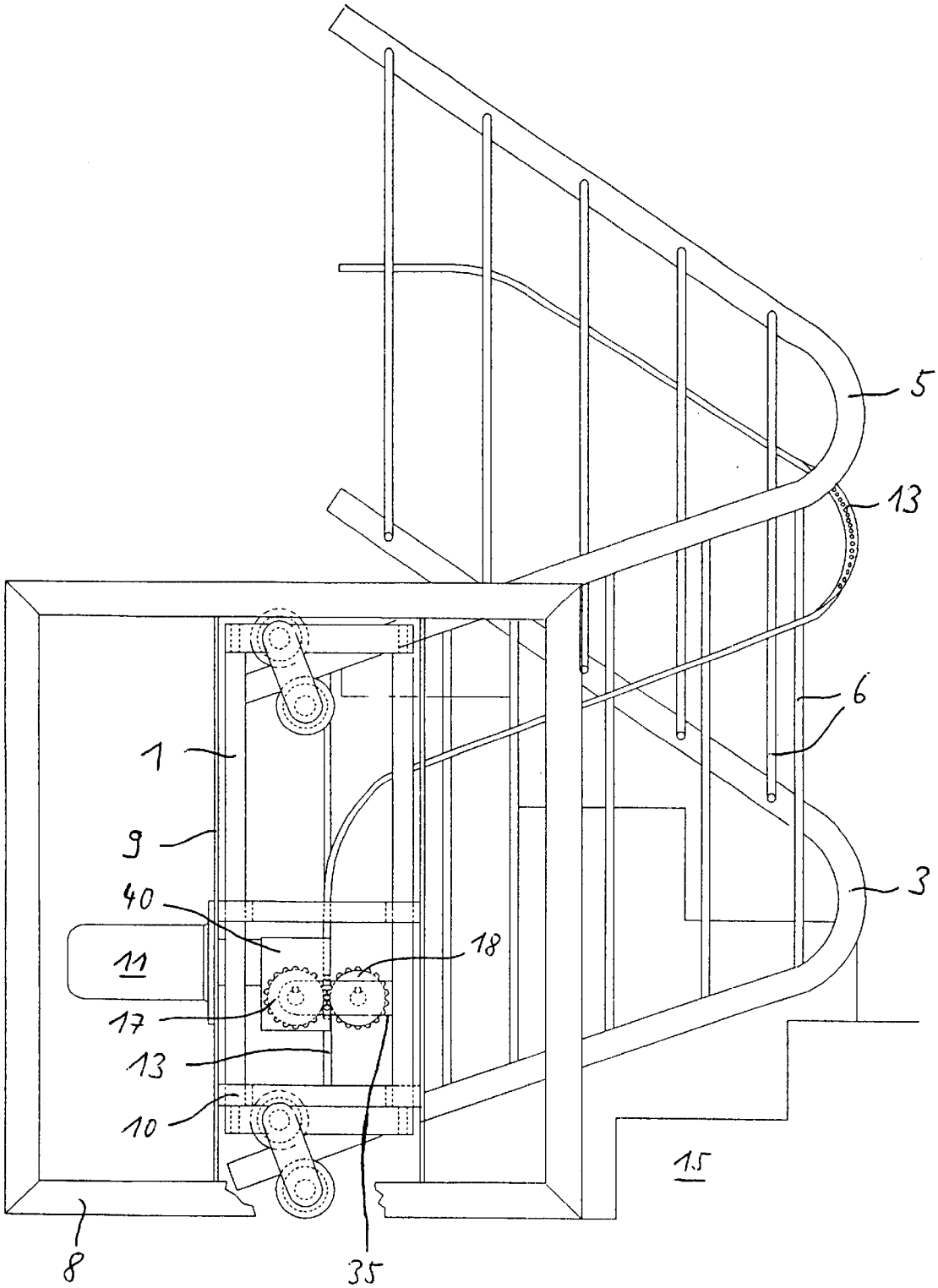
FIG. 3 is a side-elevational view corresponding to FIG. 2 on an enlarged scale.

As is also shown in FIG. 3, a gear mechanism 40 is flanged on the drive motor 11, a pair of gearwheel-like drive wheels 17, 18 being retained pivotably on the gear mechanism 40, and the drive wheels 17, 18 accommodating the perforated bar 13 between them.

Figure 4:
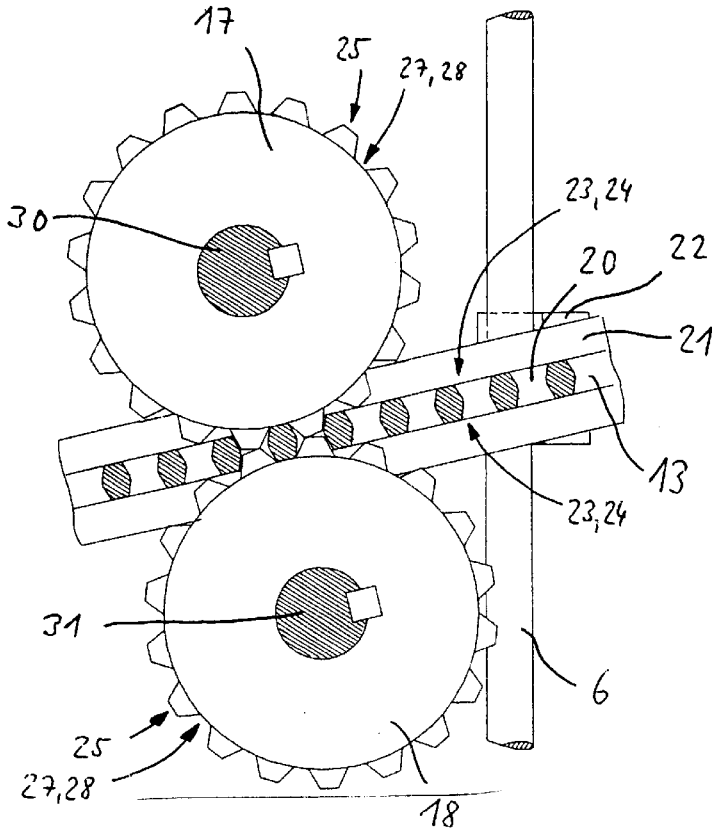
FIG. 4 is a sectional view of the engagement conditions between two drive wheels and a perforated bar.
Figure 5:
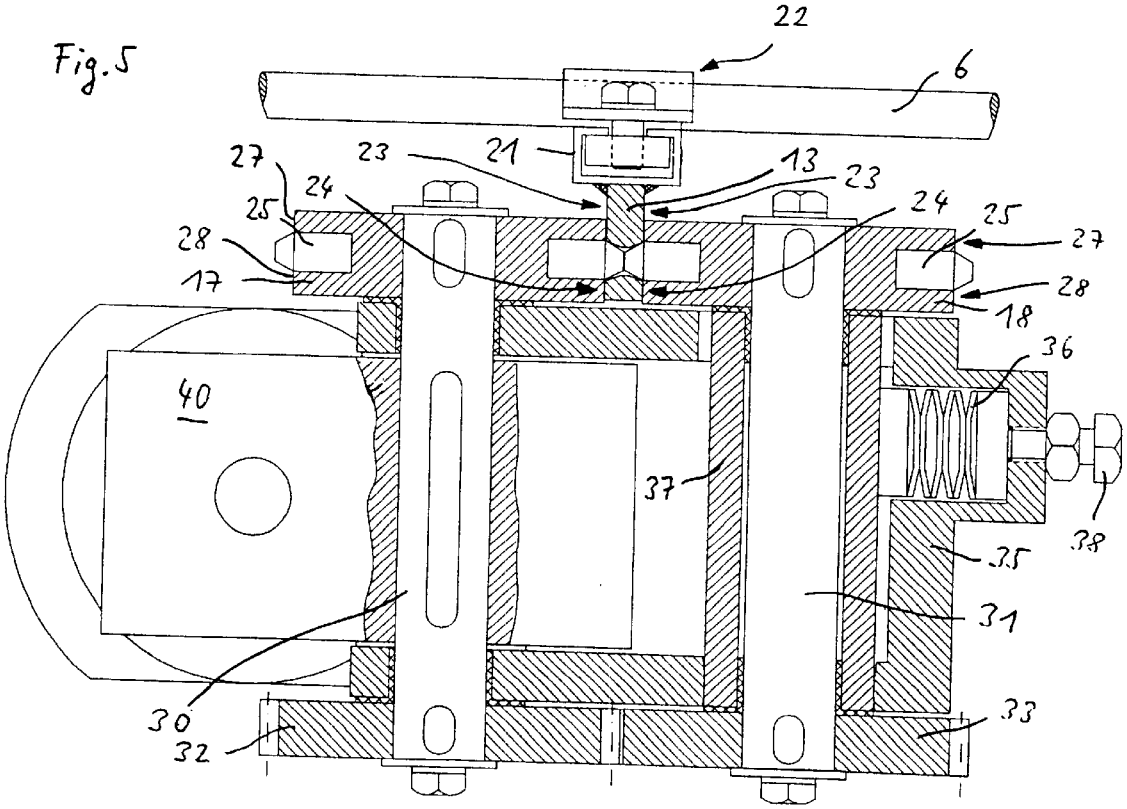
FIG. 5 is a sectional view of the drive wheels, a perforated bar and a bearing housing.

FIGS. 4 and 5 help to explain further the drive engagement between the drive wheels 17, 18 and the perforated bar 13. The perforated bar 13 contains a flat steel bar (see FIGS. 4 and 5) which contains a plurality of engagement openings 20 spaced at regular intervals in a longitudinal direction and in a form of double truncated cones. A reinforcing profile 21 is welded to the flat steel bar. The perforated bar 13 is then fitted in a height-adjustable and inclination-adjustable manner on each upright 6 by corresponding fastening devices 22 (e.g. adjusting clip).

The perforated bar 13 has on a top side and underside, in each case on both sides adjacent to the engagement openings 20, mutually opposite running surfaces 23, 24 with which the drive wheels 17, 18 interact (additionally) in a friction-fitting or force-fitting manner.

As FIG. 5 shows, the cylindrical drive wheels have bolts 25 inserted in them, those end sections of the bolts 25 which project out of the drive wheels 17, 18 tapering in the form of a truncated cone, and the engagement openings 20 of the perforated bar 13 being of a corresponding configuration (in the form of double truncated cones 20). Alternatively, it would be possible to provide shaping here in the form of involute toothing. The engagement openings 20 may also be (punched or laser-cut) in cylindrical form, in which case the truncated-cone form is only formed during operation, following a running-in period.

As FIGS. 4 and 5 also show, the drive wheels 17, 18 have on their outer circumferential surfaces, in each case laterally adjacent to the row of bolts 25, annular or cylindrical drive surfaces 27, 28 which are uninterrupted in the circumferential direction and by way of which the drive wheels 17, 18 interact with the corresponding running surfaces 23, 24 of the perforated bar 13. Since end sections of the bolts 25 of the two drive wheels 17, 18 should not come into contact, they only project beyond the circumferential surfaces of the drive wheels 17, 18 to an extent corresponding to not more than half the thickness of the perforated bar 13.

As can also be gathered from FIG. 5, the drive wheels 17, 18 are keyed in a rotationally fixed manner on shafts 30, 31, on which coupling gearwheels 32, 33 are likewise keyed in a rotationally fixed manner. This results in that the drive wheels 17, 18 are coupled to one another so as to be driven at the same rotational speed in opposite directions of rotation. The shafts 30, 31 are mounted in a housing 35. It being possible for the shaft 31 to be moved slightly, by a bearing sleeve 37 which is subjected to the force of cup springs 36, in a direction transverse to its axial direction (in the region of the end section carrying the drive wheel 18). The results in an effective adjustment of the radial contact-pressure force by which the drive surfaces 27, 28 are pressed against the running surfaces 23, 24 and is adjustable by an adjusting screw 38 acting on the cup springs 36. The contact-pressure force may be adjusted such that, for example, 30% or even 50% of the overall propelling force which is to be transmitted is transmitted in a friction-fitting manner, while the rest is transmitted in a form-fitting manner by the interaction of the bolts 25 with the engagement openings 20.

As is also indicated in FIG. 5, the housing 35 is retained on the gear mechanism 40 such that it can be pivoted by way of the shaft 30, the drive wheels 17, 18 being driven via the drive motor 11, the gear mechanism 40 and the coupling gearwheels 32, 33. The shaft 30 is thus stationary relative to the gear mechanism 40 as far as its axial position is concerned, while the housing 35 and the shaft 31 execute a pivoting movement about the longitudinal axis of the shaft 30 and can thus follow any desired predeterminable progression of the perforated bar 13.

At the bottom end point of its movement, the lift, or the load-bearing configuration 1 and the carrying frame 8, is respectively located in a bottom end position, which is illustrated in FIGS. 2 and 3. In particular the carrying frame 8, together with the drive motor 11, the gear mechanism 40 and the drive wheels 17, 18, are displaced downward along the load-bearing configuration 1 and along the vertical region of the perforated bar 13. In a region in front of the lowermost stair 15 of a staircase which is to be ascended using the lift, the carrying frame 8 is thus located in a position which allows a wheelchair or the like to be loaded, or to roll, without difficulty onto a horizontal platform of the carrying frame 8.

In order for the lift to move upward along the staircase, the carrying frame 8 has to overcome a vertical difference in height, which corresponds to the height of the lowermost stair 15 of the staircase, since otherwise it cannot be displaced in a direction parallel to the guide rails 3, 5. For this purpose, in a first movement section, the carrying frame 8 is moved vertically upward, for which purpose all that is required is for the drive motor 11 to be moved since the perforated bar 13 is guided in a correspondingly vertical manner. As soon as the drive wheels 17, 18 reach the curved transition section of the perforated bar 13, deviating from the vertical direction, the carrying frame 8 has reached a sufficient height, with the result that its bottom front edge cannot any longer strike against a stair, and the lift or the load-bearing configuration 1 attains, in accordance with the perforated bar 13, a forward component in the direction of the guide rails 3, 5. Following passage through the transition section, the travelling position according to FIG. 1 is reached, in which case the housing 35, which retains the drive wheels 17 and 18, has pivoted automatically corresponding to the local inclination or curvature of the perforated bar 13.

It is advantageous for it to be possible for the perforated bar 13, as a flat steel bar, to be bent and twisted by straightforward methods, a follow-up and/or precision adjustment also being possible during installation on account of the flexible fastening on the vertical uprights 6. Furthermore, the bores of the perforated bar 13 allow straightforward rolling of the drive surfaces 27, 28 of the drive wheels 17, 18 and also of the bolts 25, in particular over curves and in transition regions.

Since the carrying frame 8 automatically and forcibly follows the progression of the perforated bar 13, the guide rails or tubular guides 3, 5 can follow the progression of the staircase without it being necessary to take account of the movement progression of the front edge of the carrying frame 8 (advancement).

The carrying frame 8 may be raised, in front of the first stair, by up to 400 mm, with the result that the guide rails and the handrail are lowered by a corresponding distance relative to the carrying frame 8.

Figure 6:
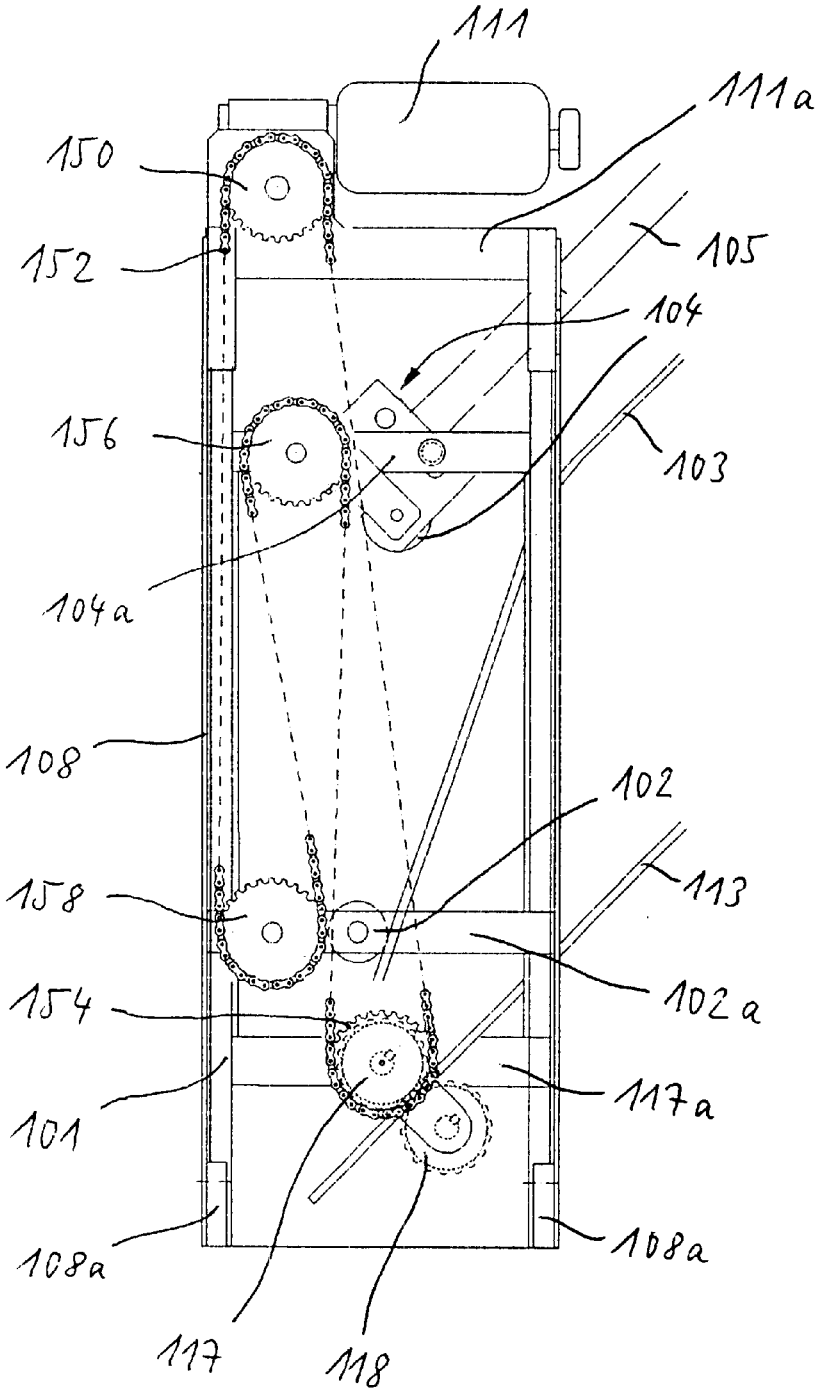
FIG. 6 is a side-elevational view of a modified embodiment in a lowered position.
Figure 7:
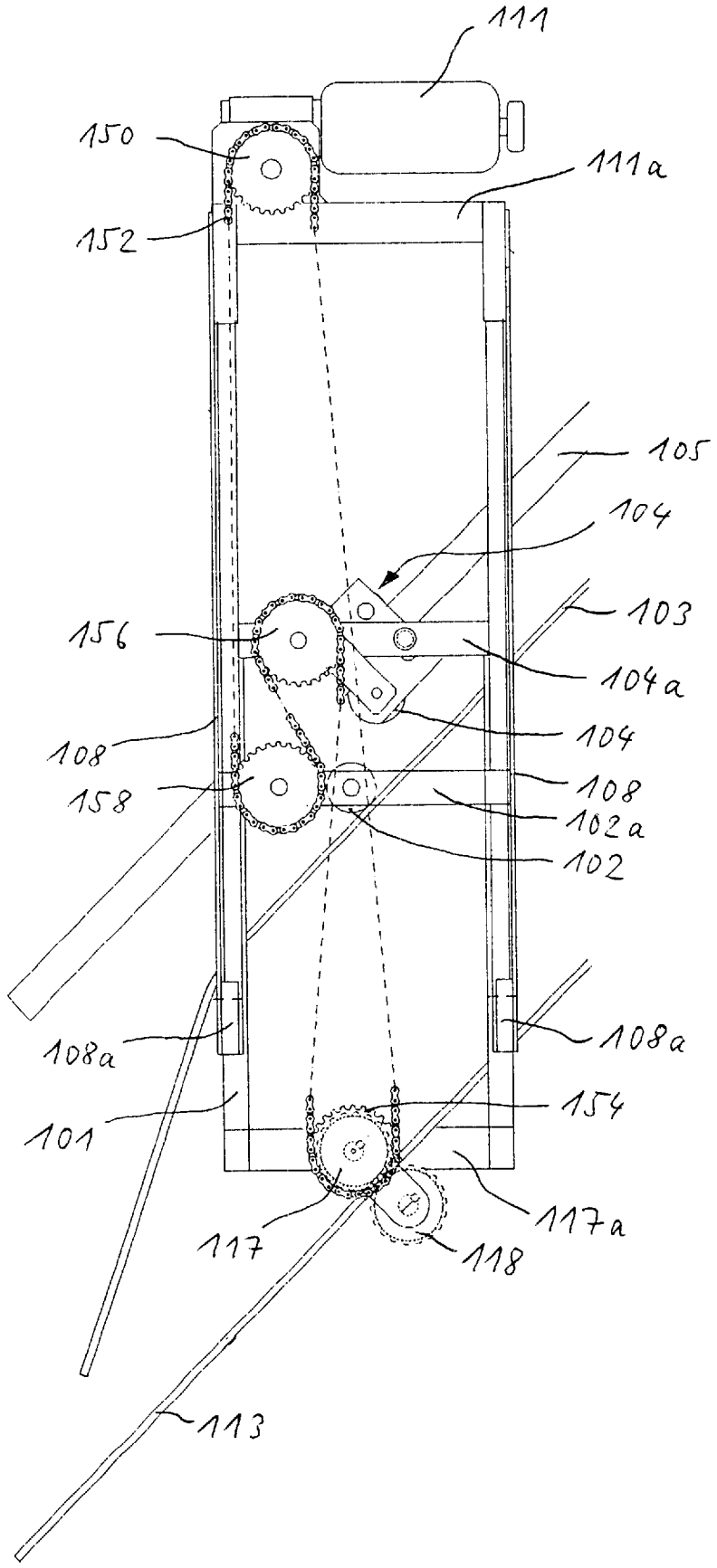
FIG. 7 is a side-elevational view of a travelling position of the modified embodiment.

FIGS. 6 and 7 show a further embodiment of the invention. A load-bearing configuration 101 is mounted and guided displaceably on a second, top guide rail 105 by guide rollers 104, the guide rollers 104 being fitted on a transverse strut 104*a* of the load-bearing configuration 101. Moreover, the load-bearing configuration 101 is guided, and can be driven, on a perforated bar 113 by drive wheels 117, 118, the perforated-bar 113 and drive-wheel configuration corresponding to the preceding embodiment. The drive wheels 117 and 118 are mounted on a further transverse strut 117*a* of the load-bearing configuration 101 such that they can be rotated and prestressed, preferably by a spring force, in relation to the perforated bar 113.

As can be gathered from FIGS. 6 and 7 together, a carrying frame 108 which bears a load which is to be transported is mounted in a vertically displaceable manner on the load-bearing configuration 101. Indicated at the bottom end of the carrying frame 108 is a platform frame 108*a* on which it is possible to fasten a base accommodating, for example, a wheelchair.

The carrying frame 108 (and thus also the load-bearing configuration 101) is guided along a first, bottom guide rail 103 by a guide roller 102 mounted on a transverse strut 102*a* of the carrying frame. A vertical position of the carrying frame 108 relative to the load-bearing configuration 101 results from the respective local vertical spacing between the guide rails 103 and 105, as can be seen from FIGS. 6 and 7.

When the stair lift is thus moved from the position illustrated in FIG. 6, in which the guide roller 102 is located in a region of the bottom guide rail 103 in which the bottom guide rail is in a lowered position relative to the top guide rail 105, into the position illustrated in FIG. 7, in which the guide roller 102 is located on a section of the bottom guide rail 103 which is closer to the top guide rail 105, the guide roller 102, and thus the entire carrying frame 108 is moved vertically upward relative to the load-bearing configuration 101, in a manner corresponding to the decreasing spacing between the bottom guide rail 103 and top guide rail 105.

If the top guide rail 105 is a handrail of a staircase, it follows that a wheelchair or the like positioned on the carrying frame 108 in the region of the platform frame 108*a* is raised from the lowered position, which is illustrated in FIG. 6, before any considerable (forward) movement in the longitudinal direction of the staircase takes place. This results in the task of initially ascending the lowermost stair of a staircase section, this task having been described in conjunction with the first embodiment, is thus easily possible.

A drive motor 111 is fitted on a top transverse strut 111*a* of the carrying frame 108 and acts, via a drive chain wheel 150 and an endlessly circulating chain 152, on a chain wheel 154 which is fixed to the drive wheel 117. Following the drive chain wheel 150 and the chain wheel 154, the drive chain 152 is routed over a first deflecting wheel 156, which is mounted rotatably on the top transverse strut 104*a* of the load-bearing configuration 101, and over a second deflecting wheel 158, which is mounted rotatably on the bottom transverse strut 102*a* of the carrying frame 108. This configuration achieves the situation where, in the case of a transfer from a lower position of the carrying frame 108, as is illustrated in FIG. 6, into a travelling position with the carrying frame 108 raised, as is illustrated in FIG. 7, the tractive force of the drive chain facilitates the operation of raising the carrying frame 108 loaded with a load which is to be transported, with the result that this lifting force need not be transmitted and applied exclusively by the bottom guide rail 103 and the guide roller 102.

A resulting raising force acting on the carrying frame 108 is produced in that via the deflecting wheel 158, which is connected to the carrying frame 108 via the strut 102*a*, two upwardly directed, approximately equal tractive chain forces are active, whereas only one downwardly directed tractive chain force, namely that of the chain section running between the drive chain wheel 150 and chain wheel 154, is active. The raising force thus corresponds, in first approximation, to the tractive chain force.

Figure 8:
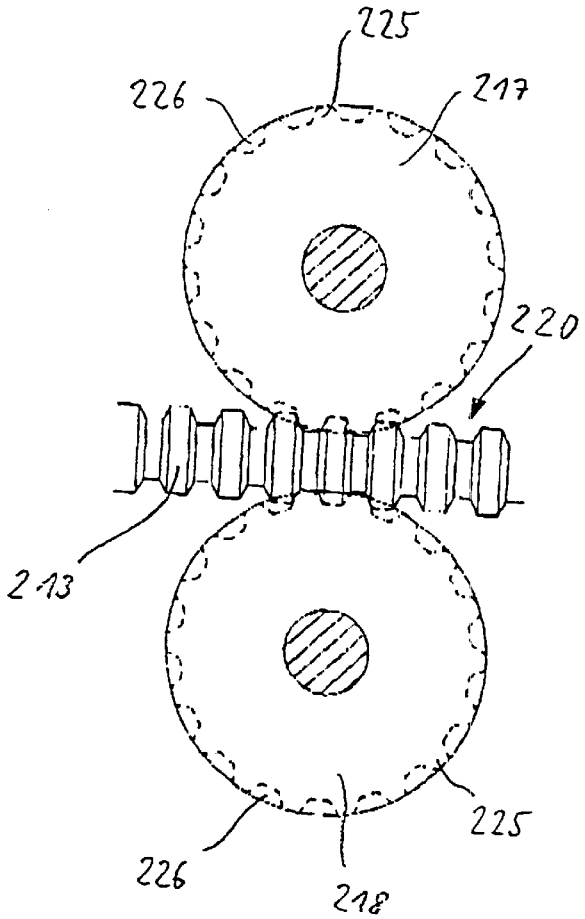
FIG. 8 is a side-elevational view of a second embodiment of the drive bar.
Figure 9:
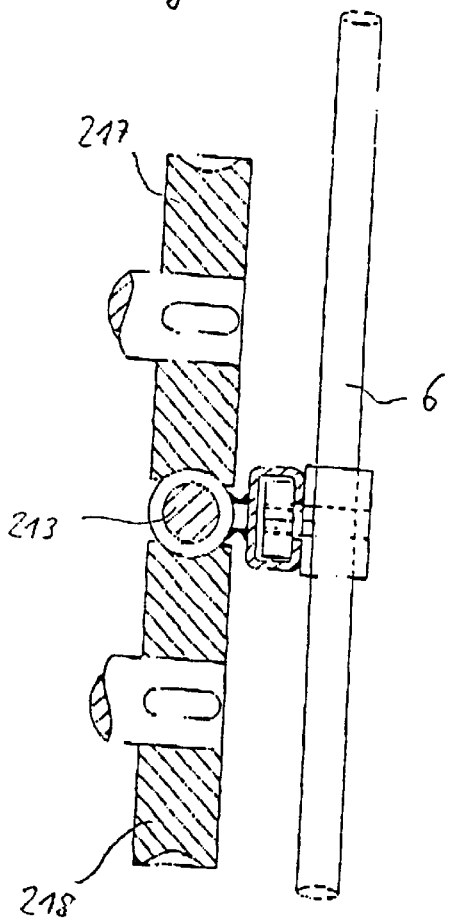
FIG. 9 is a sectional view of the a second embodiment of the drive bar.

FIGS. 8 and 9 show an alternative embodiment of the drive rail 13, use being made, instead of a perforated bar and of drive wheels provided with bolts, of drive wheels 217, 218 with drive protrusions 225, and grooves 226 essentially in the form of truncated cones, in interaction with a corresponding grooved bar 213. Such drive wheels can be produced more cost-effectively than drive wheels provided with bolts. A grooved bar may likewise be produced more cost-effectively, for example by spinning or striking, as with threaded spindles or screws.

The grooved bar 213 is bent in the cold state, an additional twisting operation, which is necessary in the case of a rectangular perforated bar, being dispensed with.

Figure 10:
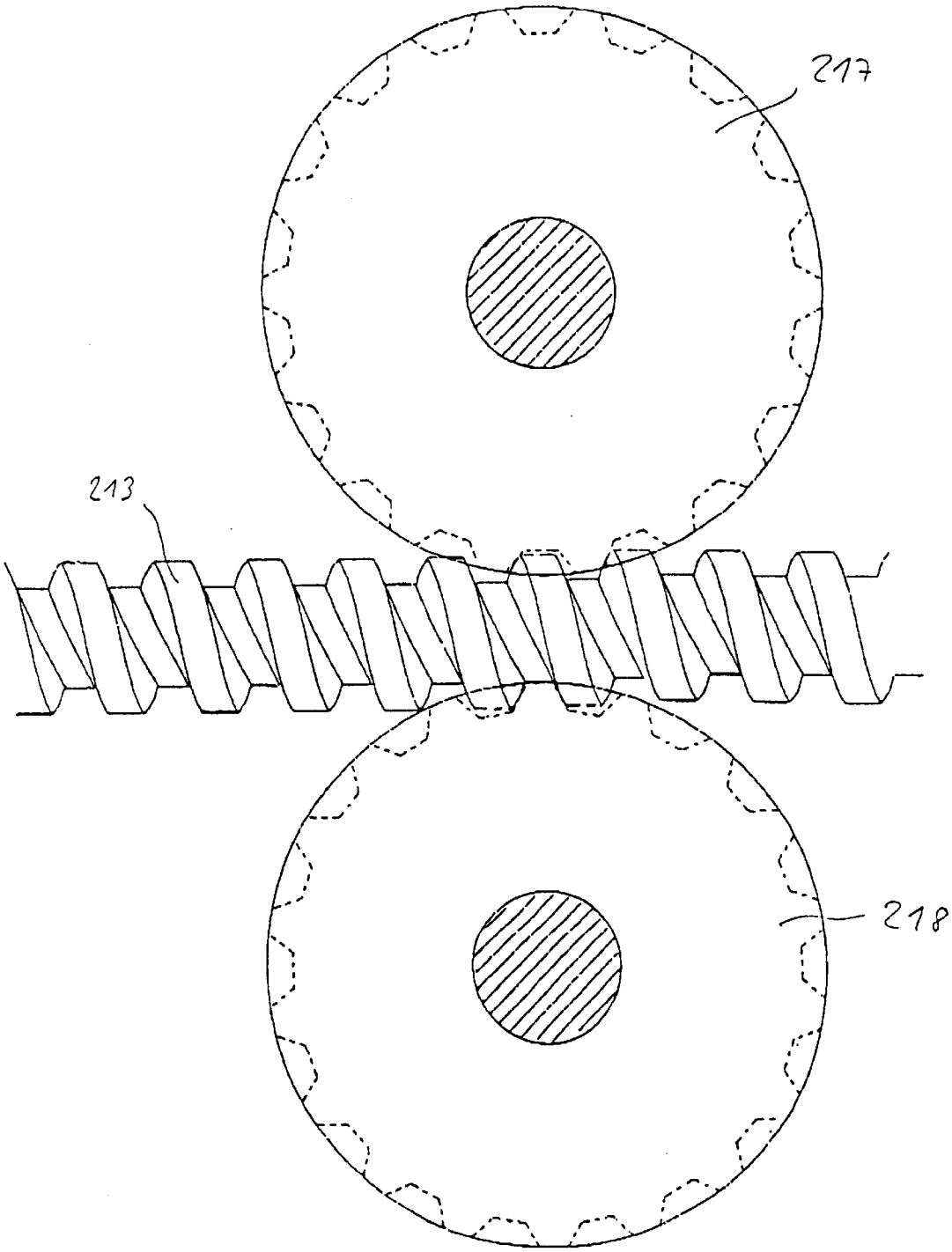
FIG. 10 is a side-elevational view of a third embodiment of the drive bar.

As FIG. 10 shows, it is also possible for the drive bar 213 to be provided with a helical groove, this resulting in a screw form. The drive wheels are then approximately in the form of worm wheels.

I claim:

1. A drive configuration for stair lifts, comprising:

a load-bearing configuration which is to be mounted displaceably on guide rails including a first guide rail and a second guide rail;

a drive rail having engagement openings formed therein and spaced apart at regular intervals in a longitudinal direction; and a drive unit interacting with said drive rail and supported by said load-bearing configuration, said drive unit having two gearwheel-shaped drive wheels disposed opposite one another and accommodating said drive rail with a contact-pressure force acting on said drive wheels to engage said drive rail, said drive wheels having radially projecting drive protrusions interacting with said engagement openings in a form-fitting drive connection.

2. The drive configuration according to 1, wherein said drive rail is a perforated bar having said engagement openings formed therein and two uninterrupted, mutually opposite running surfaces, said drive wheels having drive surfaces which are uninterrupted in a circumferential direction and interact with said running surfaces in a force-fitting drive connection.

3. The drive configuration according to claim 2, wherein said perforated bar has in each case one of said running surfaces disposed on each side of said engagement openings, and said drive wheels have in each case one of said drive surfaces on each side of said drive protrusions.

4. The drive configuration according to claim 2, wherein said perforated bar is produced from a flat steel bar and said engagement openings are punched.

5. The drive configuration according to claim 2, wherein said drive protrusions are in a form of truncated cones and said engagement openings are in a form of double truncated cones.

6. The drive configuration according to claim 2, including:

a carrying frame bearing a load which is to be carried is mounted in a vertically displaceable manner on said load-bearing configuration, said drive wheels being mounted on said load-bearing configuration and said carrying frame having at least one carrying roller and is guided and supported on one of the guide rails by way of said at least one carrying roller;

a drive motor disposed on said carrying frame;

a chain wheel connected in a rotationally fixed manner to one of said drive wheels;

a first deflecting wheel disposed on said load-bearing configuration;

a second deflecting wheel disposed on said carrying frame; and an endless drive chain driving said one of said drive wheels, said endless drive chain being guided in each case over said first deflecting wheel and said second deflecting wheel, so that, during operation of the drive configuration, tractive chain forces result in a vertically upwardly directed raising force between said load-bearing configuration and said carrying frame.

7. The drive configuration according to claim 6, wherein said load-bearing configuration is guided and supported on the second guide rail and on said perforated bar, said drive rail being disposed at a fixed spacing beneath the second guide rail.

8. The drive configuration according to claim 6, wherein said carrying frame is to be supported on the first guide rail, the first guide rail is to be disposed at one of a predeterminable and adjustable, locally different spacing from the second guide rail and the drive rail, as a result of which it is possible to predetermine a local vertical position of said carrying frame relative to said load-bearing configuration.

9. The drive configuration according to claim 8, wherein said carrying frame is to be supported on the first guide rail by said at least one carrying roller.

10. The drive configuration according to claim 6, wherein said load-bearing configuration has a pair of rollers for supporting said load-bearing configuration on the second guide rail.

11. The drive configuration according to claim 6, wherein said carrying frame has a top region and said drive motor is disposed in said top region of said carrying frame.

12. The drive configuration according to claim 6, including a drive chain wheel driven by said drive motor, said endless drive chain is routed to said second deflecting wheel, and, from there, to said first deflecting wheel and, from there, to said chain wheel and back to said drive chain wheel.

13. The drive configuration according to claim 1, wherein said drive rail having said engagement openings is a groove bar with grooves formed therein and spaced apart at regular intervals in the longitudinal direction.

14. The drive configuration according to claim 1, wherein said drive rail has a given thickness and said drive protrusions have a radial length corresponding approximately to half of said given thickness of said drive rail.

15. The drive configuration according to claim 1, wherein said drive protrusions are bolts inserted into said drive wheels.

16. The drive configuration according to claim 1, wherein said drive protrusions on said drive wheels are spaced apart by an angle of 20° in a circumferential direction.

17. The drive configuration according to claim 1, including a pressure assembly having springs for producing an adjustable contact-pressure force being the contact pressure force exerted on said drive wheels.

18. The drive configuration according to claim 1, wherein said drive unit has inter-engaging coupling gearwheels and shafts, each of said drive wheels is mounted on one of said shafts, said shafts being parallel to each other and connected in a rotationally fixed manner to said inter-engaging coupling gearwheels.

19. The drive configuration according to claim 18, including:

a carrying frame which bears a load which is to be transported and is mounted in a vertically displaceable manner on said load-bearing configuration; and a housing carrying said drive wheels being retained pivotably on said carrying frame, and resulting in that with a progression of said drive wheels along said drive rail, said housing defining a height position of said carrying frame relative to said load-bearing configuration.

20. The drive configuration according to claim 19, including a drive motor fixed on said carrying frame and having a gear mechanism, said housing being retained such that it can be pivoted about one of said shafts.

21. The drive configuration according to claim 1, wherein said drive rail is retained at a fixed spacing from the guide rails and is fitted such that it is angle-adjustable and height-adjustable.

22. The drive configuration according to claim 1, wherein said drive rail is to be retained on uprights which are disposed between the guide rails.

23. The drive configuration according to claim 1, wherein in an end region of the guide rails, said drive rail is guided in a direction of the first guide rail.

24. The drive configuration according to claim 1, wherein said load-bearing configuration has guide rollers and is guided on the guide rails in each case by two of said guide rollers.

25. The drive configuration according to claim 1, including a platform for transporting a transportable load and disposed on said carrying frame.

26. The drive configuration according to claim 1, wherein said drive rail is retained at locally different spacings from the guide rails and is fitted such that it is angle-adjustable and height-adjustable.

27. A stair lift, comprising:

a drive configuration, including:

a load-bearing configuration which is to be mounted displaceably on guide rails including a first guide rail and a second guide rail;

a drive rail having engagement openings formed therein and spaced apart at regular intervals in a longitudinal direction; and a drive unit interacting with said drive rail and supported by said load-bearing configuration, said drive unit having two gearwheel-shaped drive wheels disposed opposite one another and accommodating said drive rail with a contact-pressure force acting on said drive wheels to engage said drive rail, said drive wheels having radially projecting drive protrusions interacting with said engagement openings in a form-fitting drive connection.

* * * * *